United States Patent [19]

Evans

[11] Patent Number: 4,944,172

[45] Date of Patent: Jul. 31, 1990

[54] METHOD OF MAKING A U-SHAPED CLOSURE TAMPER EVIDENT

[75] Inventor: Alfred J. Evans, Raleigh, N.C.

[73] Assignee: Delaware Capital Formation Inc., Apex, N.C.

[21] Appl. No.: 270,230

[22] Filed: Nov. 14, 1988

[51] Int. Cl.[5] ..... B24C 1/00

[52] U.S. Cl. ..... 72/53; 29/90.7; 51/319; 59/75; 24/30.5 W

[58] Field of Search ..... 72/53; 29/90.7; 24/30.5 W, 30.5 R; 51/319, 320, 410; 59/75

[56] References Cited

U.S. PATENT DOCUMENTS

| | | | |
|---|---|---|---|
| 3,073,022 | 1/1963 | Bush et al. | 72/53 |
| 3,400,433 | 9/1968 | Klenz | 24/30.5 W |
| 3,564,663 | 2/1971 | Roberts | 24/30.5 W |
| 4,581,913 | 4/1986 | Reed | 72/53 |

FOREIGN PATENT DOCUMENTS

| | | | |
|---|---|---|---|
| 0279015 | 12/1987 | Japan | 72/53 |

OTHER PUBLICATIONS

"Glass Bead Impact Blasting", by Michael Woelfel and Robert Mulhall, *Metal Progress*, 9/1982, vol. 122, No. 4.

"Shot Peening", by American Wheelabrator & Equ. Corp., 1946, pp. 2, 3, 4, 5, 6, 7, 8, and 9–14.

*Primary Examiner*—David Jones

*Attorney, Agent, or Firm*—Allegretti & Witcoff, Ltd.

[57] ABSTRACT

An improved, integral, U-shaped metal clip for use as a closure includes a textured surface to enhance the strength of the clip and to evidence tampering. The texturing may be effected by one or more working steps on the surface.

3 Claims, 1 Drawing Sheet

METHOD OF MAKING A U-SHAPED CLOSURE TAMPER EVIDENT

BACKGROUND OF THE INVENTION

This invention relates to an improved clip useful as a closure for packaging.

Numerous patents disclose apparatus for attaching a U-shaped metal clip about packaging. Typical of such patents is Pat. No. 2,880,419, entitled APPARATUS FOR FASTENING CASING WITH STAPLE LIKE FASTENERS, issued Apr. 7, 1959; Pat. No. 3,543,378, for a CLIPPING APPARATUS, issued Dec. 1, 1970; Pat. No. 3,583,056 for a CLIPPING DEVICE, issued June 8, 1971; and Pat. No. 4,675,945 for a CLIPPING APPARATUS, issued June 30, 1987.

The metal clip utilized in such apparatus for attachment about a package has evolved from a simple U-shaped clip having a circular cross section into a clip with various unique cross sectional shapes and features. Among prior art patents which teach clip constructions are Pat. No. 3,400,433 for a CLIPPING DEVICE issued Sept. 10, 1968 and Pat. No. 4,528,898 for an INVERTED T-CROSS SECTION CLIP, issued July 2, 1985. These patents and the references cited therein are incorporated herewith by reference. Pat. No. 3,400,433 discloses a generally rhombehedral cross section for a U-shaped metal clip. Pat. No. 4,528,898 discloses a T-shaped cross sectional shape for a metal clip.

Such clip constructions have proven to be quite useful particularly with respect to closure of packaging for materials which are extruded from a product discharge tube into casing. The clips are thus used to seal the ends of tubular casing used for packaging a variety of products. The amount of clip material used to effect each closure is preferably a minimum. Further, it is desirable that the clip be constructed in a manner which will evidence any tampering with the package that is closed by the clip. Additionally, it is desirable to provide improved, economic manufacturing techniques for making such clips Finally, it is desirable to provide clips which can be used in existing clipping apparatus.

SUMMARY OF THE INVENTION

Briefly, the present invention relates to an improved U-shaped metal clip that is used as a closure for packaging. The clip is comprised of generally parallel, opposed legs connected by a crown. In a preferred embodiment, the clip has a generally uniform cross section, and the outer surface of the clip is textured in a generally uniform pattern. The clip may have a variety of cross sectional shapes. Additionally, the surface texture may be varied to provide for distinctive mechanical characteristics of the clip. Further, the clip surface may be heat treated and knurled or otherwise conditioned after texturing in order to relieve or otherwise affect stresses associated with the surface of the clip as a result of the texturing operation.

Thus, it is the object of the present invention to provide and improved clip construction for U-shaped clips.

Another object of the invention is to provide a clip which utilizes less material than equivalent prior art clips yet which provides equal or improved mechanical strength and mechanical properties relative to prior art clips.

Yet another object of the invention is to provide a clip which may be manufactured from wire formed by roll forming and similar techniques.

Another object of the invention is to provide a clip which may be used with existing clip attachment equipment.

Yet a further object of the invention is to provide a clip which is economical to use as well as manufacture.

One further object of the invention is to provide a clip which is "tamper evident."

These and other object advantages and features of the clip will be set forth in the detailed description which follows.

BRIEF DESCRIPTION OF THE DRAWING

In the detailed description which follows, reference will be made to the drawing comprised of the following Figures.

DESCRIPTION OF THE PREFERRED EMBODIMENT

The clip of the present invention is typically a U-shaped metal clip made from an aluminum alloy wire such as the aluminum alloy designated ASTM No. 5056. Typically, the aluminum alloy rod is drawn into a wire form. Subsequently the surface thereof is textured in accord with the following description. The wire is then formed as a U-shaped metal clip, for example, by the technique taught in Klenz U.S. Pat. No. 3,611,509, METHOD AND APPARATUS FOR FORMING CLIP, issued Oct. 12, 1971.

Thus, a typical clip incorporating the present invention will include first and second parallel, opposed legs 10 and 12 which are of equal length with respect to one another and with the coined ends. The legs 10 and 12 are connected by an integral crown 14. The clip is U-shaped and is deformable about packaging material in the manner described, for example, in U.S. Pat. No. 4,880,419 previously referenced. Numerous other prior art patents teach the apparatus for deformation of such U-shaped metal clips and the use of such clips in packaging operations The cross sectional shape of the clips may be varied depending upon desires of the manufacturer. Prior art Pat. Nos. 3,400,433 and 4,525,898 disclose but a few of the cross sectional shapes for such clips. Generally, such cross sectional shapes are uniform throughout the length of the clip. However, the uniformity of cross section is not a limiting feature of the invention.

Figure 1:
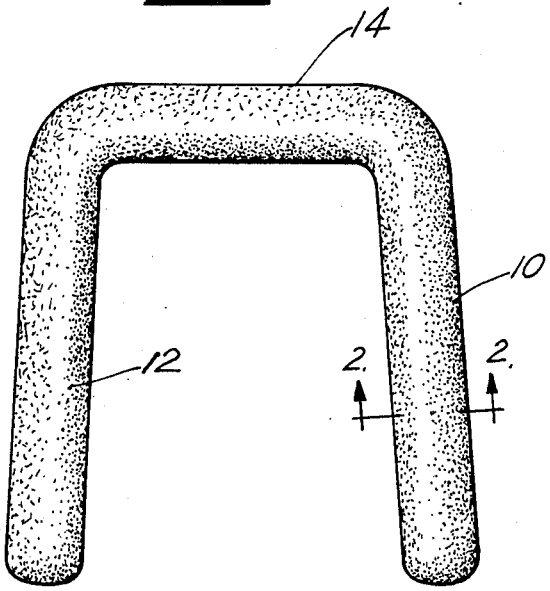
FIG. 1 is a plan view of a typical clip incorporating the improvements of the present invention.
Figure 2:
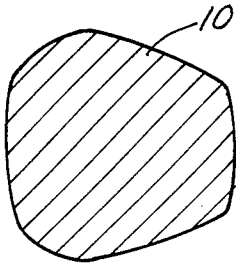
FIG. 2 is a cross sectional view of a clip of FIG. 1 taken along the line 2—2.
Figure 3:
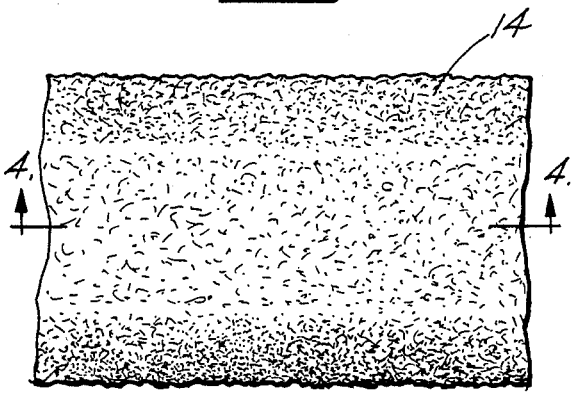
FIG. 3 is an enlarged plan view depicting the textured surface of the clip of FIG. 1.

An important and critical feature of the present invention is represented by FIG. 3 wherein the surface of the wire which is formed into the clip is textured to effect work hardening relative to the interior of the clip. Texturing of the surface may be effected by any of a variety of techniques including mechanical working such as through a knurling or swaging. Other techniques for working of the surface include shot peening and bead blasting. In a preferred method of manufacture and embodiment of the invention the working of the surface of the clip is accomplished in two steps: first, a course working step and second, a fine working step. For example, the surface of the wire may first be shot peened or knurled. This would be followed by bead blasting.

It has been found that the shot peening will effectively work harden the surface and material slightly beneath the surface of the clip. The fine bead blasting which follows the course shot peening operation will effectively act as a stress relieving operation analogous to annealing. Of course, the clip can be knurled or annealed after a course working operation.

Yet another alternative for texturing of the surface of the wire which is formed into the clip comprises the use of textured rolls. Such rolls may be textured by shot peening and bead blasting as well as by various electric discharge machining techniques.

In practice the initial shot peening provides for a roughness in the range of approximately 500 to 1000 microinches as defined in ANSI B46.1. This will be followed by a second step of bead blasting wherein the final roughness of the surface is in the range of approximately 100 to 500 microinches.

Multiple variations of the described techniques are possible in order to enhance the utility of the clip. The surface of the clip may, for example, be non-uniformly textured with portions of the surface remaining untextured while other portions of the surface will be textured. The texturing may be varied in degree over the surface of the clip. A single knurling, peening or blasting operation may be effected on the surface of the clip. Form rolls by which the wire for the clips is formed may be carbide blasted while soft for deep penetration and sharp, random penetration. The form rolls are then heat treated. In a wire forming machine, the wire is rolled through the roils to desired wire cross section geometry. That imparts high compressive stresses in the outer fibers. The ultimate objective is, however, to provide some work hardening and texturing associated with the surface of the clip to thereby enhance the strength of the clip particularly when it is formed as a closure. Additionally, when the surface is so textured, any tampering of the closure associated with the clip will be quite evident. That is, tampering with evidence itself as a scratch on the textured surface.

Following is a table indicating a range of texturing operations which may be applied to the surface of a clip and indicating the various types of conditions that may be imparted to a clip construction.

| TEXTURING OPERATION | ROUGHNESS RANGE | MATERIAL CHARACTERISTIC IMPROVEMENTS |
|---|---|---|
| Knurling | 500–1000 | Yield improvement up to 8 percent, dependent on roughness |
| Shot Peening | 500–1000 | Yield improvement up to 8 percent, dependent on roughness |
| Bead Blasting | 100–500 | Elongation improvement up to 3 percent, with yield improvement retained |

Figure 4:
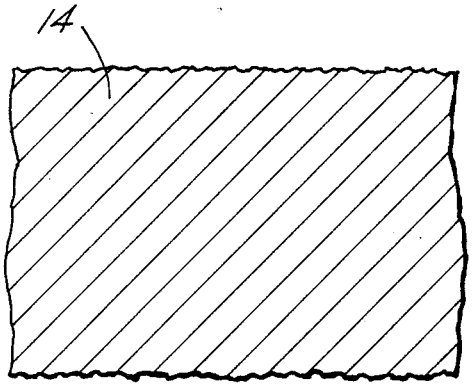
FIG. 4 is an enlarged cross sectional view of the clip of FIG. 3 illustrating of texturing of the surface of the clip.

FIGS. 3 and 4 represent the appearance of the surface of a clip that is surface conditioned as described.

Variations of the construction and method may be effected without departing from the scope of the invention. The invention is therefore, to be limited only by the following claims and there equivalent.

What is claimed is:

1. In the method for manufacture of an integral, U-shaped metal clip, the improvement comprising the steps of:

a. forming a length of wire by wire drawing techniques with a substantially uniform cross section and a minimum cross sectional area of approximately 0.005 square inches and a maximum cross sectional area of approximately 0.44 square inches;

b. initially texturing and work hardening the surface of the wire substantially uniformly to provide a roughness in the range of about 500 to 1000 micro-inches;

c. stress relieving the work hardened surface by further texturing the surface to a roughness in the range of about 100 to 500 micro-inches; and d. forming an integral length of the wire into a U-shaped metal clip, whereby the formed clip surface is tamper evident and the strength of the clip is enhanced relative to a clip formed without surface texturing.

2. The improved method of claim 1 wherein said first work hardening and texturing step is effected by shot peening and the second step is effected by bead blasting.

3. The improved method of claim 1 including the additional step of forming the clip as a closure on a package.

* * * * *